US005913905A

United States Patent [19]

Fleissner

[11] Patent Number: 5,913,905

[45] Date of Patent: Jun. 22, 1999

[54] DEVICE FOR APPLYING A LIQUID FILM TO A CONTINUOUSLY ADVANCED WEB OF GOODS

[75] Inventor: Gerold Fleissner, Zug, Switzerland

[73] Assignee: Fleissner GmbH & Co. Maschinenfabrik, Egelsbach, Germany

[21] Appl. No.: 08/988,985

[22] Filed: Dec. 11, 1997

[30] Foreign Application Priority Data

Dec. 12, 1996 [DE] Germany ..... 196 51 576

[51] Int. Cl.[6] ..... D06B 1/06

[52] U.S. Cl. ..... 68/205 R; 118/325

[58] Field of Search ..... 68/200, 205 R; 118/324, 325

[56] References Cited

U.S. PATENT DOCUMENTS

| | | | |
|---|---|---|---|
| 3,667,258 | 6/1972 | Newton | 68/205 R |
| 4,656,845 | 4/1987 | Fleissner | 68/205 R |
| 5,243,841 | 9/1993 | Fleissner | 68/205 R |
| 5,737,945 | 4/1998 | Fleissner | 68/200 |

*Primary Examiner*—Philip R. Coe

*Attorney, Agent, or Firm*—Antonelli, Terry, Stout & Kraus, LLP

[57] ABSTRACT

In dye applicators that operate by the pouring principle, it is known to store the liquid flowing over an overflow barrier in a liquid supply chamber located in front of it. To produce a dye applicator that can be adjusted to the desired working width, this liquid supply chamber is divided several times by a limiting wall and a liquid supply bore is associated with each of the liquid supply chambers thus formed. The liquid supplied through hoses to the individual supply chambers is distributed stepwise in such fashion that the respective supply openings are connected at both ends in the direction of the working width with first branch lines of the same length, at whose respective ends intermediate outflow openings are provided, to which second branch lines are connected in the same fashion on both sides in the direction of the working width, with said lines being shorter by half of the first branch lines and having a reduced cross section, with the outflow openings provided at the ends for example. According to the invention, the respective first branch lines are located in a plane parallel to that of the outflow openings and the liquid is distributed to the outflow openings through the second branch lines from the plane of the first branch lines to the plane of the outflow openings. In this manner, a fine striped pattern can be produced by dying.

9 Claims, 4 Drawing Sheets

DEVICE FOR APPLYING A LIQUID FILM TO A CONTINUOUSLY ADVANCED WEB OF GOODS

BACKGROUND OF THE INVENTION

DE 35 33 320 A1 teaches a device for applying a liquid film of considerable width, flowing in a laminar fashion and uniformly thin across the working width, to a continuously advanced web of goods with a liquid supply chamber, said chamber being delimited firstly by a barrier directed upwards diagonally to the horizontal and extending across the working width, said barrier being followed in the flow direction of the liquid by an overflow guard as well as a guiding surface abutting the overflow guard, from the lower end of which guiding surface the overflowing liquid film runs onto the web of goods, with said chamber being delimited secondly by an opposite barrier located at a distance from the first barrier. This device has proved itself for uniform distribution of a thin film of liquid across the working width of the web of goods.

A dye applicator is generally designed for a specific working width. In practice, however, the arriving webs of textile vary in width, possibly even in the short term. According to previous DE 195 25 458.9 A1, a supplement to the previously known device has been developed wherein the abovementioned liquid supply chamber has at the end opposite the overflow guard, a liquid supply area in which a plurality of liquid outflow openings terminate, said openings being connected by liquid supply hoses supplied with liquid by a pump, with the liquid supply chamber extending across the working width being divided over its width by a plurality of limiting walls extending in the gap of the liquid supply chamber from the overflow guard to the liquid supply area. Now it has been made possible in simple fashion to reduce the maximum design working width in short order to any desired size or to enlarge it again later without the quality or the uniformity of the liquid application being adversely affected.

In such a device, it is advantageously possible to permit a rapid dye change with a linear color change. A prerequisite for this is a small liquid volume within the entire applicator, with the new liquid flowing in forcing the old liquid out continuously and completely. This is made possible with the information from DE 40 26 198 A1, with the distribution of the liquid from each of the inflow openings to a plurality of outflow openings being provided stepwise in such fashion that the respective inflow opening is connected on both sides in the direction of the working width with a first branch line of the same length at whose respective end an intermediate outflow opening is provided, through which, in the same fashion, on both sides in the direction of the working width, a second branch line, but one which is shorter by half of the first branch line and has a reduced cross section, is connected for example with the outflow openings provided at the ends.

These facts can be implemented jointly in a device. The device therefore not only permits a uniformly distributed liquid film across the working width, but also a rapid change in both the width of the film and in the color being applied, with the color change taking place sharply and linearly.

A device of this kind is basically used only for continuous dying of a web of goods of a certain width. There is also the goal of using this optimum device for producing patterns, for example colored stripes. Of course, it is basically possible to provide each inflow opening or one above the other with a supply hose through which a different dye flows to the dye applicator. This dye is then distributed across the working width among the various branch lines and then flows in a constant width onto the web of goods. This width however is too coarse for finer striped patterns, for which reason the problem still remains of being able to dye patterns of this kind with a fine striped pattern.

SUMMARY OF THE INVENTION

Taking its departure from such a device the goal of the present invention is achieved by virtue of the fact that the first branch line in each case is located in a plane that is parallel to that of the outflow openings and the distribution of the liquid to the outflow openings by the second branch line is provided from the plane of the first branch line to the plane of the outflow openings. By this measure, it is now possible to distribute the liquid from one inflow opening at various points across the working width into selected outflow openings, and it is merely necessary to provide suitable lines to which a different liquid can be supplied alternately.

In one advantageous embodiment of the basic type, provision is also made for locating the first branch lines from the plane of the outflow openings perpendicularly, preferably alternately with a space between, in one direction and then in the other, and then allowing the intermediate outflow openings to run parallel to the plane of the inflow openings. In this case, the first branch lines should run in a straight line in the direction of the working width, but the second branch lines must run from the offset plane of the first branch lines circularly or linearly into the plane of the outflow openings. In this manner, a finer distribution of the liquid that flows to the inflow openings through hoses is made possible.

Additional designs supplement the device according to this definition. Reference is made in this regard to the specification and the Claims.

For the first time, pure dying in stripes is possible, something which was previously possible only by printing. By supplying different dyes with interruptions, a transverse pattern can also be produced with this device. Since this color pattern as well as the associated manufacturing method are novel, both the method and the web of goods produced thereby are included among the items protected by this application.

BRIEF DESCRIPTION OF THE DRAWINGS

A device of the species according to the invention is shown as an example in the drawing.

DETAILED DESCRIPTION OF THE PREFERRED EMBODIMENTS

Figure 1:
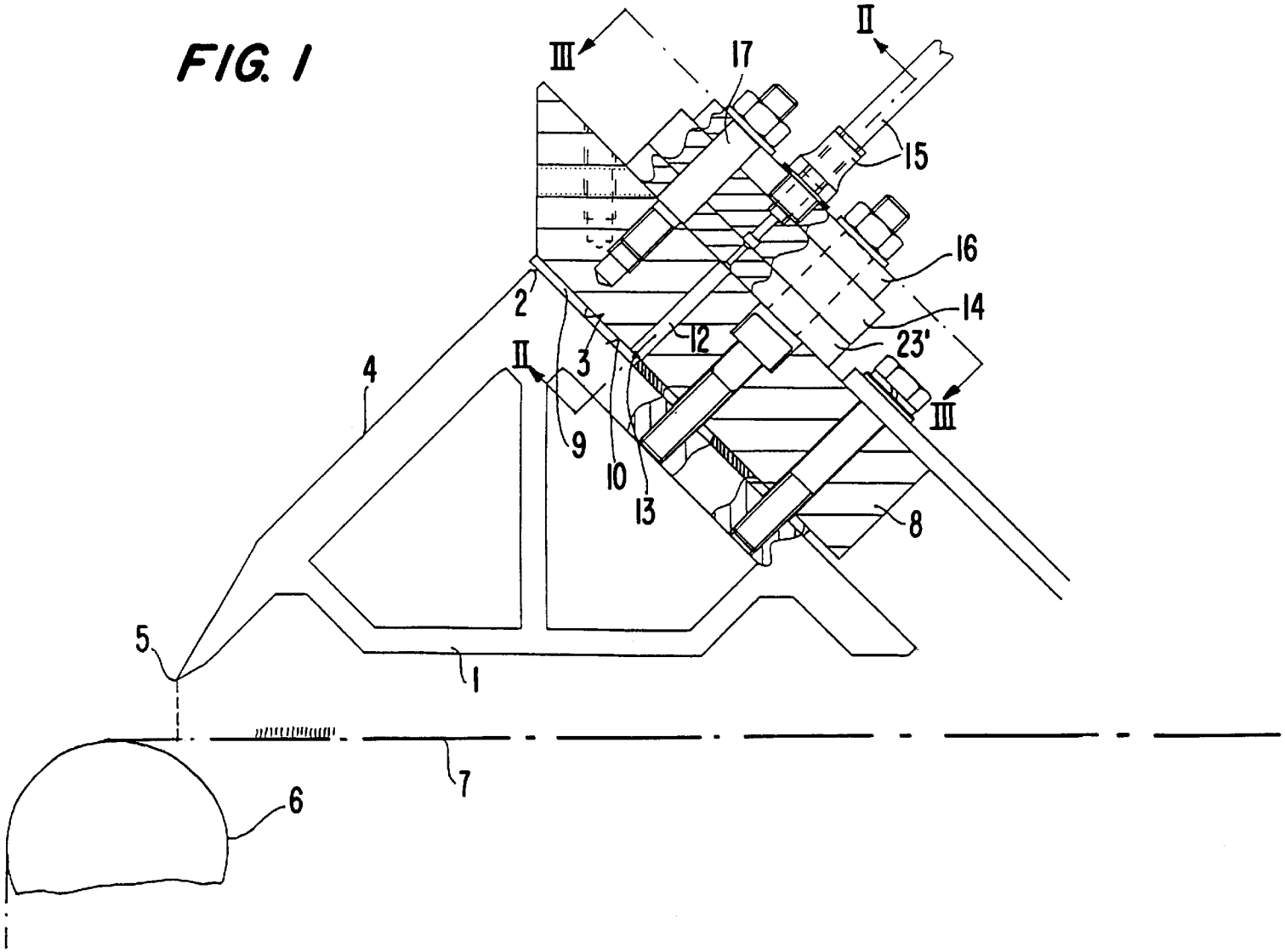
FIG. 1 shows a cross section through the beams of the liquid applicator with the liquid distribution walls mounted on the beam.

The liquid applicator that belongs to the prior art and is shown in FIG. 1 consists of an angular beam 1 whose overflow guard 2, spanning 90°, is directed upward. The leg that extends diagonally upward with respect to overflow guard 2 is the barrier 3 that guide surface 4 abuts after the overflow guard 2 which is rounded in this case. The liquid film to be applied flows uniformly distributed over this guide surface, said film, after running off the lower edge 5 of guide surface 4, flowing onto web of goods 7, said web of goods being guided over a roller 6 in the form of a pile.

On the side opposite barrier 3 of beam 1, a solid body 8 is mounted in a liquid-tight fashion, said body having a liquid supply chamber 9 in the area facing overflow barrier 2. This liquid supply chamber 9 is formed heightwise according to FIG. 1 by a wall 19' inserted across the width of the device, said wall having openings 13 in the fluid inflow area to allow the liquid to flow in through supply chamber 9. This will be described further below in connection with FIG. 3. The liquid is supplied through a plurality of bores 12 that extend transversely through body 8, said bores extending across the width of the device in FIG. 2.

Figure 2:
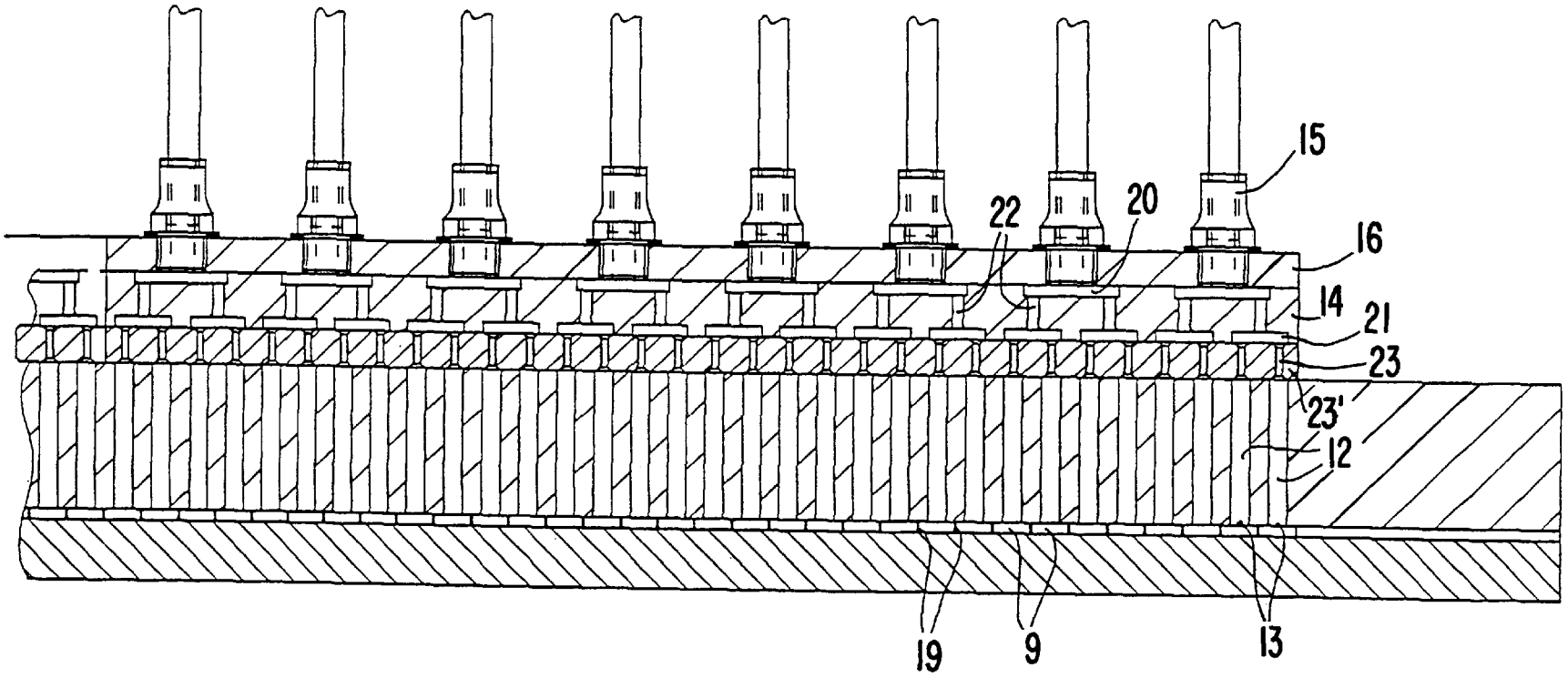
FIG. 2 is a section parallel to the plane of the liquid distribution lines along line II—II in FIG. 1.

On the opposite, upper end of bores 12 a liquid distributing device is located, shown in detail in FIG. 2, as described in DE 40 26 198 A1. It consists of fluid flowing in from a supply line 15 being divided stepwise into individual bores 12. Two branch lines 20, 21 are provided here, with the respective inflow openings of supply lines 15 being connected at both ends in the direction of the working width with a first branch line 20 of equal length, at whose respective ends intermediate outflow openings 22 are provided, to which are attached, in the same fashion on both sides in the direction of the working width, a branch line 21 that is shorter by half of first branch line 20 and has a smaller cross section, with outflow openings 23 provided at the ends, into a third distributing wall 23' for bores 12 in body 8. Liquid distributing plate 14 is sealed by a lid 16 in a liquid-tight fashion, said lid being permanently joined to body 8 by screws 17.

Figure 3:
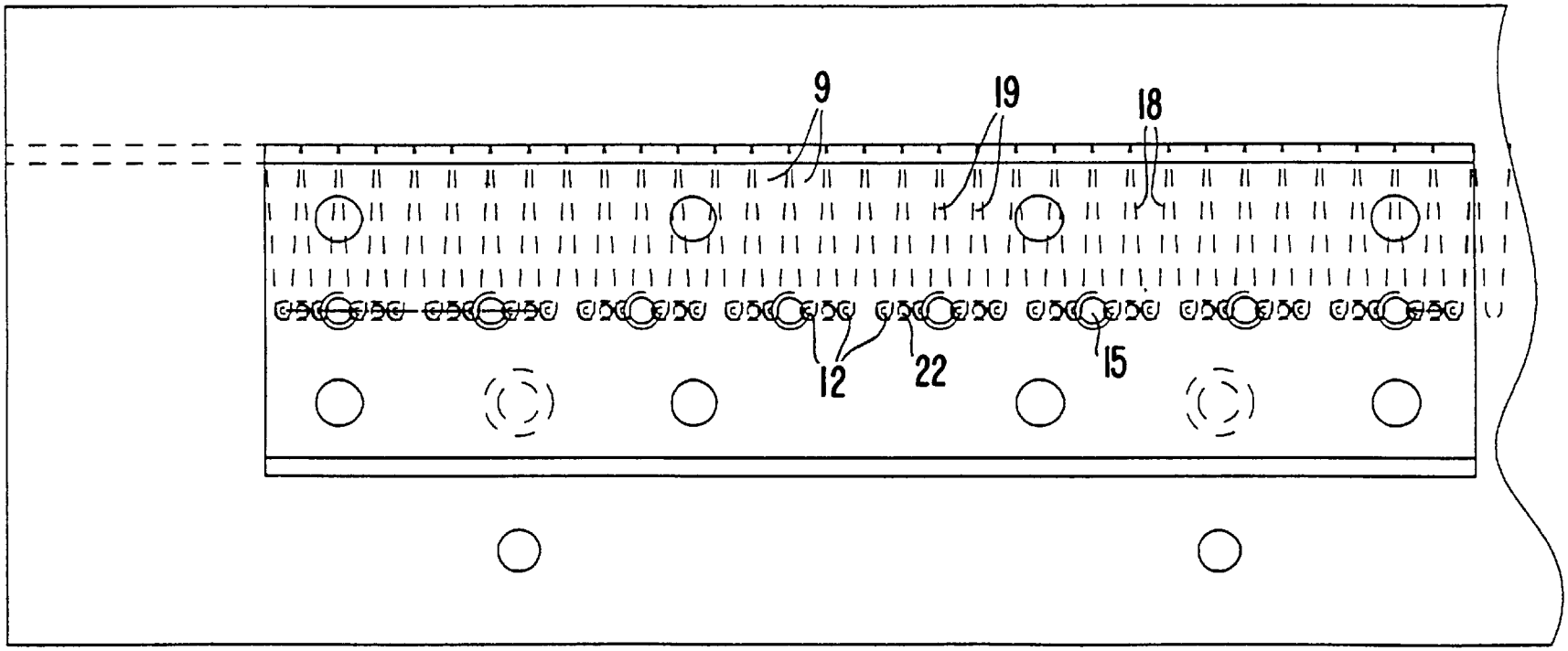
FIG. 3 is a top view of the first of three distribution walls (lids) looking in the direction of section III—III with the limiting walls in the liquid supply chamber indicated by the broken lines.

The design of liquid supply chambers 9 is clear from FIG. 3. The additional flow of the liquid entering through bores 12 up to overflow barrier 2 takes place through a plurality of liquid supply chambers 9, because each liquid supply opening 13 is separated from the adjacent one by a limiting wall 19. As described above, below body 8, limiting wall 19' is provided which is designed in the shape of a comb in the vicinity of liquid supply chamber 9. At the bottom, in the seam of liquid supply chambers 9 left by limiting walls 19, bores 12 terminate, from which location the incoming liquid then flows through the respective liquid supply chambers 9 to overflow barrier 2. To obtain a supply chamber 9 that expands conically toward overflow barrier 2, flanks 18 of limiting walls 19 are directed diagonally outward from liquid inflow opening 13. In this way, a conically expanding liquid supply chamber 9 is obtained, although barrier 3 and opposite barrier 10 run parallel to one another.

In the previously known embodiment according to FIGS. 1–3, the liquid is distributed from inlet 15 to bores 12 in a plane, namely in the plane of bores 12. The plane is the sectional plane in FIG. 2. Here, the essential distributing device is provided in plate 14. With this design of distributing plate 14, it is only possible to add one other dye or the like to the applicator per liquid inlet 15, said dye then being distributed to the four corresponding bores 12 or to the four supply chambers 9 located side by side.

FIGS. 4–7 show a device, a plate 14', with which separate distribution of different dyes to each bore 12 is made possible, without supply lines 15 being located at the same intervals from one another, in other words a fixed number of supply lines 15 is provided over the length of the working width of the applicator.

Figure 4:
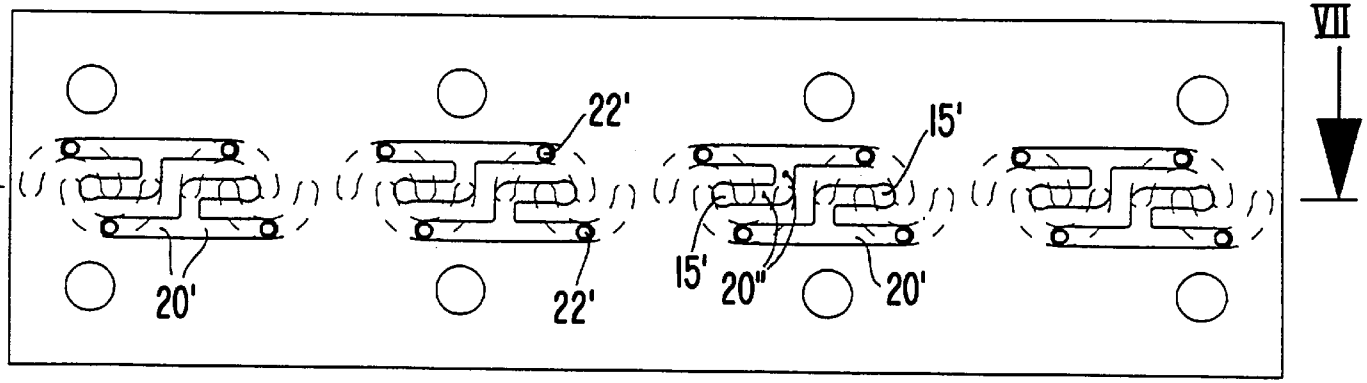
FIG. 4 is a view of the second distribution wall parallel to the wall in FIG. 3, but with a different guidance of the lines for the first branch lines to distribute the liquid to the outflow openings.
Figure 7:
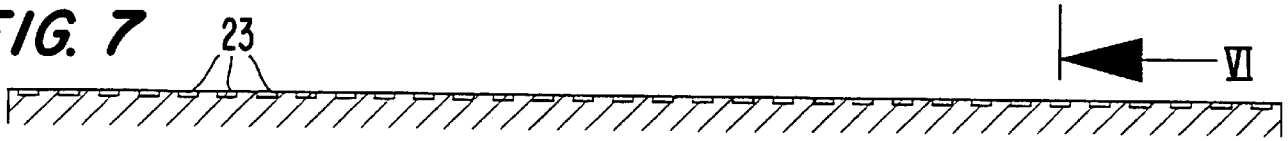
FIG. 7 is a section along line VII—VII in FIG. 4, but showing only the lower edge of the distributing wall.
Figure 6:
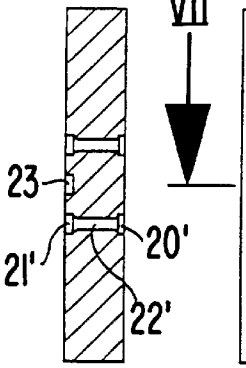
FIG. 6 is a section along line VI—VI in FIG. 4.

Above bores 15' in FIG. 4, supply lines 15 are provided with no changes. These lines are in the plane of FIG. 2. The first branch line 20' in each case however is located in a plane that is parallel to that of outflow openings 13 or supply lines 15 and the liquid is distributed to the outflow openings 13, in other words back into the plane of supply lines 15, through second branch line 21' from the plane of the first branch line to the plane of outflow openings 13. For this purpose, the first branch lines 21' are located vertically from the plane of outflow openings 13 and are staggered alternately at intervals, first and one direction and then in the other. The intermediate outflow openings 22' then run parallel to the plane of supply openings 15.

Since bores 15' and hence supply openings 15 are located in the plane of outflow openings 13, a connection must be created between supply openings 15 and first branch lines 20'. This is accomplished by connecting lines 20", which are each made the same length. Connecting lines 20" initially run in the plane of supply openings 15' and are then deflected alternately outward, first in one direction and then in the other, for central connection to associated first branch lines 20' in the parallel plane. As shown in FIG. 4, the two connecting lines 20" of adjacent supply openings 15' initially run toward one another and then in one direction or the opposite direction outward to first branch lines 20' located there.

Figure 5:
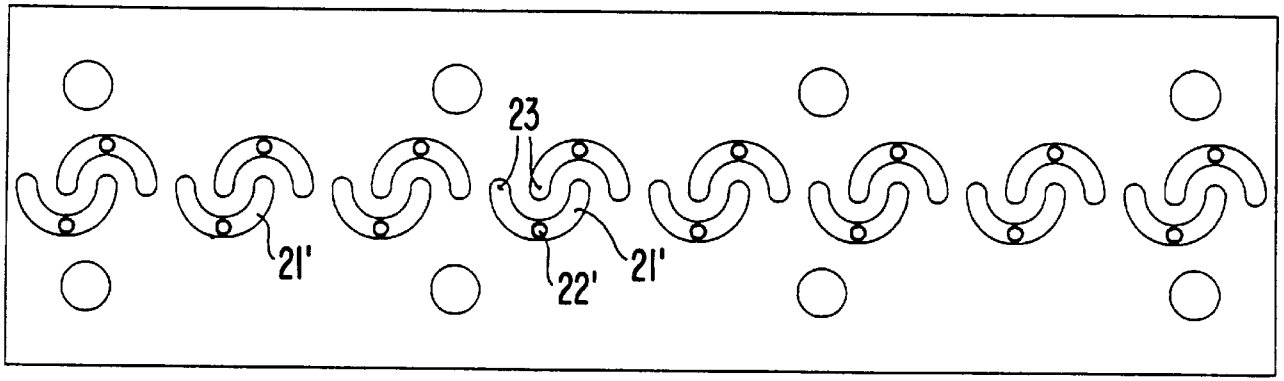
FIG. 5 is a bottom view of the second distribution wall according to FIG. 4 with the second branch lines.

In this parallel plane, in the plane of the system of first branch lines 20', intermediate outflow openings 22' made at the two outer ends of the first branch lines 20' pass through distributor plate 14'. In FIG. 5, the ends of these intermediate outflow openings 22' are shown from below distributor plate 14'. From there, second branch lines 21' run on both sides in a circle back again to the plane of outflow openings 13, where outflow openings 23 form the connection to bores 12. Since the first as well as the second branch lines also intersect in the two planes outside the plane of the outflow openings, lengthwise parallel to the plane of the working width, as can be clearly seen from FIGS. 4 and 5, distribution of the liquid into individual supply chambers 9 is made possible by this distributor plate 14' in such fashion that when adjacent supply lines 15 contain different dyes, each of adjacent supply chambers 9 is supplied with a changing dye.

In this way, a carpet in the form of a strip can be dyed with a finely striped pattern. If the dye supplied to supply line 15 is also supplied to the dye with rapid alternation, any different pattern desired can also be produced.

I claim:

1. Device for applying a liquid film of considerable working width, said film flowing in a laminar fashion in a flow direction and being uniformly thin across the wording width, to a continuously advanced web of goods, comprising a liquid supply chamber delimited on a first side by a first barrier directed upward diagonally to the horizontal and extending across the working width, said first barrier being followed in the flow direction of the liquid by an overflow barrier as well as a guide surface that abuts the overflow barrier, the liquid film overflowing a lower edge of said guide surface and running onto the web of goods said liquid supply chamber being delimited on a side opposite the first barrier by a second barrier provided at a distance from the first barrier to form a gap between the first and second barrier, with said liquid supply chamber having a liquid supply area at an end opposite the overflow barrier, in which area a plurality of liquid supply passages terminate, said liquid supply passages being connected with liquid supply hoses supplied with liquid by a pump, with said liquid supply chamber extending across the working width being divided widthwise by a plurality of limiting walls extending in the gap of the liquid supply chamber from overflow barrier to the liquid supply area, and with the liquid from each of said liquid supply hoses being distributed stepwise to said plurality of liquid supply passages in such fashion that respective inflow openings connected to said liquid supply hoses are connected to an intermediate portion of a first branch line extending in the direction of the working width, respective ends of said first branch line being connected to intermediate outflow openings, each of said intermediate outflow openings being connected to an intermediate portion of a second branch line the direction of the working width, said second branch line being shorter by half of said first branch line and having a reduced across section, said second branch line being connected with a plurality of outflow openings, each of said plurality of outflow openings being operably connected with one of said liquid supply passages, wherein each of said first branch lines is located in a plane parallel to that of said outflow openings, and the liquid is distributed to said outflow openings through said second branch lines from the plane of said first branch lines to the plane of said outflow openings.

2. Device according to claim 1, wherein said first branch lines are provided in rows offset laterally on either side of a plane containing said outflow openings, and wherein said intermediate outflow openings run parallel to said liquid supply hoses.

3. Device according to claim 2, wherein said first branch lines run in a straight line in the direction of the working width, and respective ones of said second branch lines extend out of planes containing said rows of said first branch lines in a circular or linear fashion into the plane containing said outflow openings, said outflow openings being provided at ends of said second branch lines.

4. Device according to claim 3, wherein said first as well as said second branch lines intersect lengthwise in two planes outside the plane containing said outflow openings parallel to the plane of the working width.

5. Device according to claim 2, wherein outflow openings located side by side in the plane are connected alternately by second branch lines connected with respective ones of said first branch lines in one row and then in the other row offset therefrom.

6. Device according to claim 2, wherein said inflow openings are arranged side by side in a row.

7. Device according to claim 6, wherein said inflow openings are located in the plane containing said outflow openings and a connecting line extends to the associated first branch line in the respective row offset with respect thereto, said branch lines all being made the same length.

8. Device according to claim 7, wherein said lines initially run in a plane containing the row of inflow openings and then are deflected alternately outward first in one direction and then in the other for a connection with the associated first branch lines at a central portion of each of said first branch lines.

9. Device according to claim 8, wherein two connecting lines of adjacent inflow openings are initially directed toward one another and then are deflected in one direction or in the opposite direction, outward to the first branch lines located there.

* * * * *